US005601046A

United States Patent [19]

Berglund

[11] Patent Number: 5,601,046

[45] Date of Patent: Feb. 11, 1997

[54] MEANS AND METHOD FOR DYNAMICALLY MONITORING THE STRETCH OF A SEISMIC STREAMER CABLE

[75] Inventor: Carl O. Berglund, Houston, Tex.

[73] Assignee: Teledyne Brown Engineering, Huntsville, Ala.

[21] Appl. No.: 617,301

[22] Filed: Mar. 18, 1996

[51] Int. Cl.[6] ..... B63B 21/66

[52] U.S. Cl. ..... 114/244; 114/247

[58] Field of Search ..... 114/244, 247, 114/242, 245, 253, 254; 367/20, 24, 154, 15; 174/101.5

[56] References Cited

U.S. PATENT DOCUMENTS

| | | | |
|---|---|---|---|
| 3,398,715 | 8/1968 | Burg | 114/253 |
| 3,648,226 | 3/1972 | Fitzpatrick et al. | 114/242 |
| 4,317,185 | 2/1982 | Thigpen et al. | 114/247 |
| 4,386,386 | 5/1983 | Akita | 73/862 |
| 4,726,315 | 2/1988 | Bell et al. | 114/244 |
| 4,781,140 | 11/1988 | Bell et al. | 114/244 |
| 4,821,241 | 4/1989 | Berglund | 367/154 |
| 5,090,248 | 2/1992 | Cimino et al. | 73/780 |

*Primary Examiner*—Sherman Basinger
*Attorney, Agent, or Firm*—William A. Knox

[57] ABSTRACT

A variable-gap, distributed-capacitance sensor provides an output signal that is a function of its instantaneous elongation. The sensor is integrally associated with a seismic isolator section for measuring the instantaneous stretch thereof.

6 Claims, 2 Drawing Sheets

MEANS AND METHOD FOR DYNAMICALLY MONITORING THE STRETCH OF A SEISMIC STREAMER CABLE

BACKGROUND OF THE INVENTION

1. Field of the Invention

A method for dynamically measuring the instantaneous stretch of a seismic streamer cable section as it is towed through the water behind a survey ship.

2. Discussion of Related Art

During the course of conducting a marine seismic survey, a survey ship such as 10, FIG. 1, tows a long instrumented streamer cable 14 through at or just below the surface of a body of water 12. Typically, the cable 14, which may be several kilometers long, is comprised of many separate active instrumented sections, such as 18, 18', 18", 18''' each about 75–100 meters long. The cable includes a plurality, such as 3000, of hydrophones (not shown) distributed inside the cable at preselected spaced-apart intervals therealong. The hydrophones may be divided into a sub-plurality of electrically-interconnected groups of several hydrophones each. The hydrophone groups convert compressional seismic wavefields to electrical signals which are transmitted via electrical conductors, not shown in FIG. 1, that extend along the length of the streamer cable, to archival storage electronics 20 in ship 10 following partial processing in electronics modules that are incorporated in the cable sections. The hydrophones and the electrical conductors are enclosed in a jacket, 22 (FIG. 2) made of a selected plastic such as polyurethane which may be filled with a buoyancy medium. Inside the jacket, the streamer cable includes one or more longitudinal stress members of steel or aramid fiber. Although steel stress members exhibit virtually no stretch, aramid fibers are known to have a modest modulus of elasticity.

At sea, wind and waves cause the towing ship to lurch and roll. To prevent application of undesirable jerk forces to the seismic cable, which introduce catastrophic noise to the seismic data signals, an inert isolator section 16 is inserted between the ship 10 and the streamer sections $\mathbf{18}^1$ to mechanically decouple the towing ship from the streamer cable itself. The resilient isolator section, to be discussed in detail later, consists of a plastic jacket, as with the active sections. It contains the electrical conductors and floatation means but usually no hydrophones. The isolator section may be 50–250 meters long and is capable of stretching nearly twice its own length. Elastic stress members, such as polyamide-fiber rope form part of the isolator section to limit the total stretch within preselected limits.

Three-dimensional seismic surveys require accurate knowledge of the exact spatial location of the hydrophones so that subsurface earth structure can be precisely modeled. Customarily, a precision navigation system defines the exact ship's coordinates. The hydrophone locations are then referenced with respect to the ship. The isolator section is beset with constantly-changing towing forces. Because of those forces, the length of the isolator section continuously varies by as much as 150%. Therefore, the instantaneous relative coordinates of the hydrophones in the streamer, being unpredictable with respect to the ship's position, must be monitored continuously.

One method for monitoring the disposition of one or more streamer cable sections and its accompanying hydrophones relative to the ship makes use of acoustic pingers wherein a master acoustic transducer on the ship interrogates slave transducers mounted in the streamer cables. The streamer cable configuration is determined by acoustic ranging based on the travel time of an interrogation pulse propagating through the water between the master transducer and the respective slave transducers. See for example U.S. Pat. Nos. 4,726,315 and 4,781,140, issued Feb. 23, 1988 and Nov. 1, 1988 respectively, to Robert R. Bell et al. and assigned to Teledyne Exploration Inc. Although acoustic ranging provides a first approximation of the ship-hydrophone distance, the method is fraught with error due to an imperfect knowledge of the velocity of sound through the water. That quantity varies continuously as a function of salinity, temperature and other water properties.

Linear inductive-type transducers are known but the useful stroke length is too short to be of value for this application. One such device is disclosed in U.S. Pat. No. 4,386,386, issued May 31, 1983 to Sigeyuki Akita. This device is a capacitor type displacement or load sensor that acts a variable-gap capacitor, the capacitance of which is a function of displacement.

There is a need for an accurate means for measuring the instantaneous length of an isolator section as well as variations in the length of the streamer sections themselves, particularly when aramid fibers are used as stress members in the active sections.

SUMMARY OF THE INVENTION

This invention provides a seismic cable isolator section for a seismic streamer cable. The isolator section includes at least a flexible jacket having an electrical/mechanical termination secured to each end. One or more stress members, which may be resilient, are threaded through the jacket. A bundle of electrical conductors resides in the jacket to relay seismic signals from the seismic instruments in the streamer cable, through the isolator section, to instrumentation on the ship. An internally positioned, longitudinally extensible, distributed-capacitance sensor is integrally associated with the jacket. A variable-frequency oscillator is electrically coupled to the distributed-capacitance sensor for providing a signal whose frequency is a function of the instantaneous elongation of the jacket.

BRIEF DESCRIPTION OF THE DRAWINGS

The novel features which are believed to be characteristic of the invention, both as to organization and methods of operation, together with the objects and advantages thereof, will be better understood from the following detailed description and the drawings wherein the invention is illustrated by way of example for the purpose of illustration and description only and are not intended as a definition of the limits of the invention.

DETAILED DESCRIPTION OF THE PREFERRED EMBODIMENT

Figure 1:
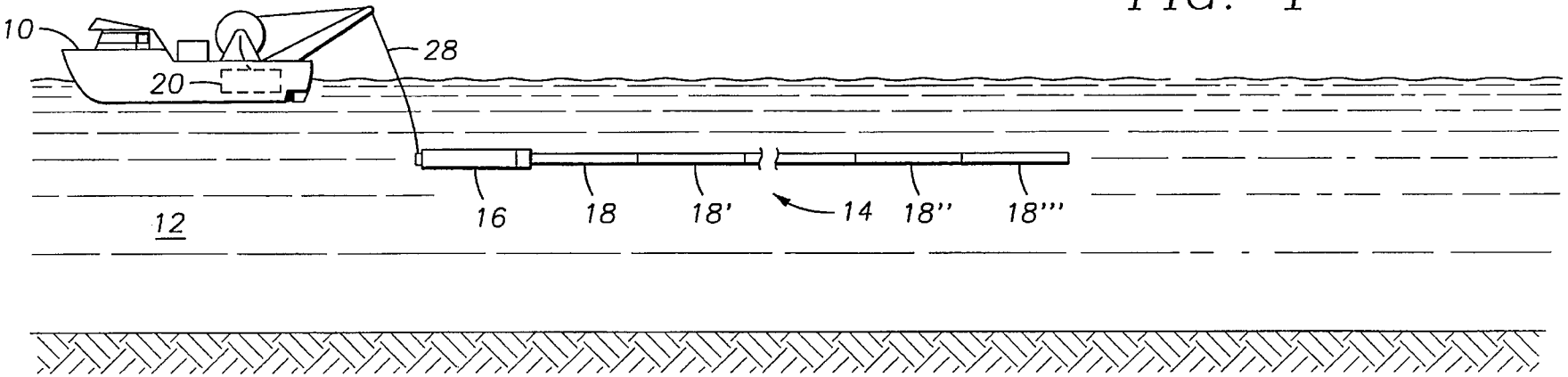
FIG. 1 shows a ship towing a streamer cable, including an isolator section, through a body of water.
Figure 2:
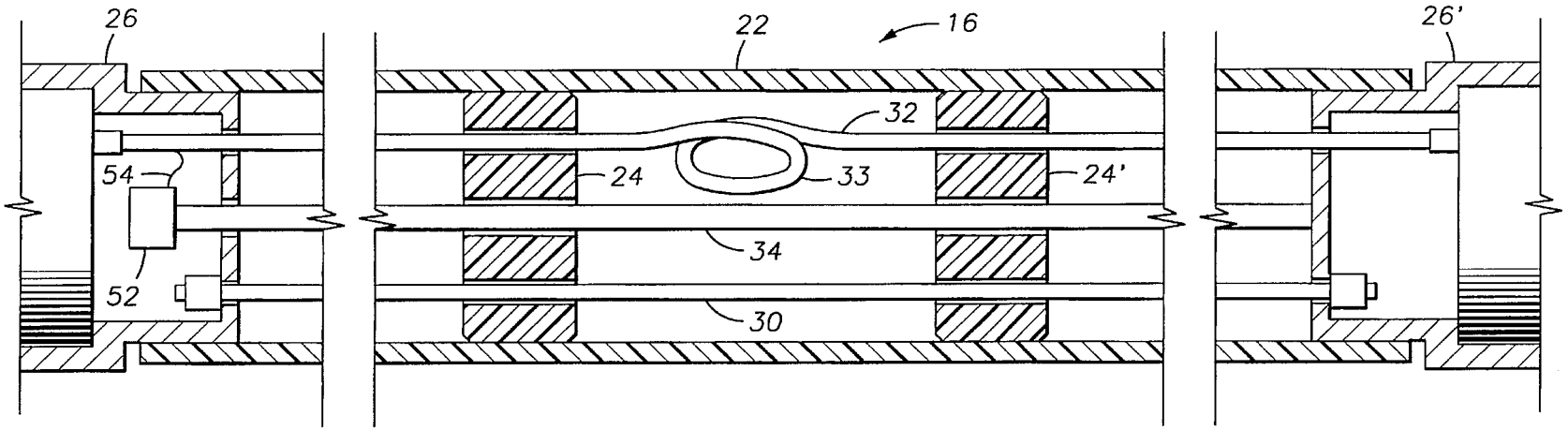
FIG. 2 illustrates the construction of a typical isolator section including an elongation sensor.

In FIG. 2, isolator section 16 consists of an outer jacket 22, the tubular integrity of which is guaranteed by a plurality of bulkheads such as 24 and 24' at spaced-apart intervals along the section such as every meter. Electromechanical terminations such as 26 and 26' are provided at the section ends. The jacket 22 is secured to the end terminations by suitable clamps of any well-known type. Terminations 26 and 26' include contacts for electrical interconnection to a towing bridle 28, FIG. 1, and to the 18[1] instrumented active sections. Terminations 26 and 26' further include knurled male/female screw fittings for mechanical cable-section interconnections. One or more polyamide-fiber stress members such as 30 extend the length of the isolator section 16 as previously explained. The polyamide-fiber stress members are fixedly secured to end terminations 26 and 26'. A plurality of electrical conductors fashioned into a conductor bundle 32, carry signals from the hydrophones in the active sections through the isolator section for connection to similar circuitry in towing bridle 28. Because isolator section 16 stretches, the conductor bundle is provided with a considerable amount of slack in the form, for example, of one or more loops such as at 33.

An elongation sensor 34 is disposed inside along the length of the isolator section, integrally associated therewith. Either a single long sensor may be used as shown or several shorter units may be employed. A single sensor would be fastened between the two end terminations when the isolator section is relaxed and not under tension. If several short sensors are used, they could be secured between selected pairs of bulkheads. The short sensors, if used, could be electrically connected together in series.

Figure 3B:
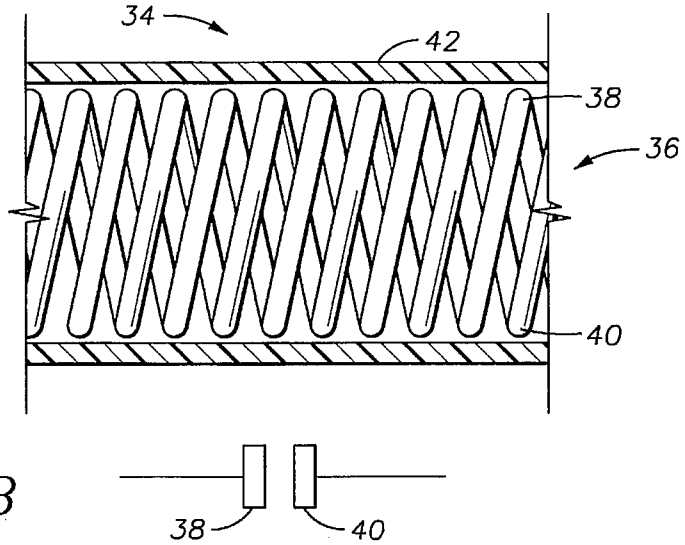
FIGS. 3A and 3B show the mechanical details of the elongation sensor in the relaxed and in the extended positions respectively.
Figure 3A:
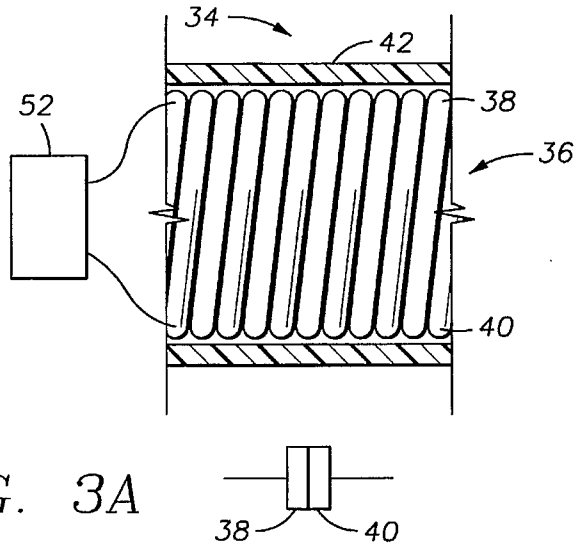

The preferred elongation sensor is a device known commercially as *The Rubbery Ruler,* which is described in U.S. Pat. No. 5,090,248 issued Feb. 25, 1992 to Alberto Comimino, which is incorporated herein by reference. The device is commercially available from Unimelb Ltd., University of Melbourne, Parkville, Victoria, Australia. The device is a wide-range, conformal, capacitative displacement transducer. It consists of a bifilar helix 36 of insulated conductive wires 38 (black circles) and 40 (open circles) embedded in a closely-fitting tube 42 of an elastomeric material as shown in FIGS. 3A and 3B which are grossly enlarged to clarity of illustration. The outer diameter of the tube 42 typically is 0.125 inch. The sensor is essentially a spring whose elongation and compliance is a function of the elastic properties of the elastomeric tubing. The elongation sensor is capable of a 200% stretch. The unit serves as a distributed capacitance wherein the two wires 38 and 40 of the double helix comprise the electrodes of a variable-gap capacitor whose capacity varies inversely as the elongation. As the sensor is stretched, the two wires of the core separate in a uniform reversible fashion that is controlled by the elastomeric covering.

FIG. 3A shows the sensor in the relaxed condition; the capacitor electrodes are separated only by the minimal thickness of the insulation. For a sensor having a length of 10 cm, a core helix of 1 mm and a 2.2 mm elastomer covering, the capacitance is 300 Pf which falls off to about 150 Pf with the elongation increased to 50 mm as suggested in FIG. 3B. The accuracy of the device is said to be 0.1%. The resolution is on the order of millimeters.

Referring back to FIG. 2, as previously stated, the elongation sensor 34 is mounted inside isolator section 16 when the section is relaxed and not under tension. The elongation sensor is operatively associated with the isolator section using any desired method of mounting that will provide assurance that the elongation of the sensor will be exactly proportional to the elongation of the jacket when the isolator is under stress. Sensor 34 may be supported at intervals along its length if needed, such as by means of bulkheads 24, to prevent a false change in capacitance by reason of catenary-type sag under its own weight. On the other hand, if a liquid buoyancy medium such as cable oil fills the isolator section, the sensor structure is so light-weight that it will tend to remain suspended in the fluid. Each end of the elongation sensor is mechanically secured firmly to the corresponding isolator end-terminations. The capacitance of the sensor, an electrostatic parameter, is a function of the instantaneous elongation of the isolator section.

Figure 4:
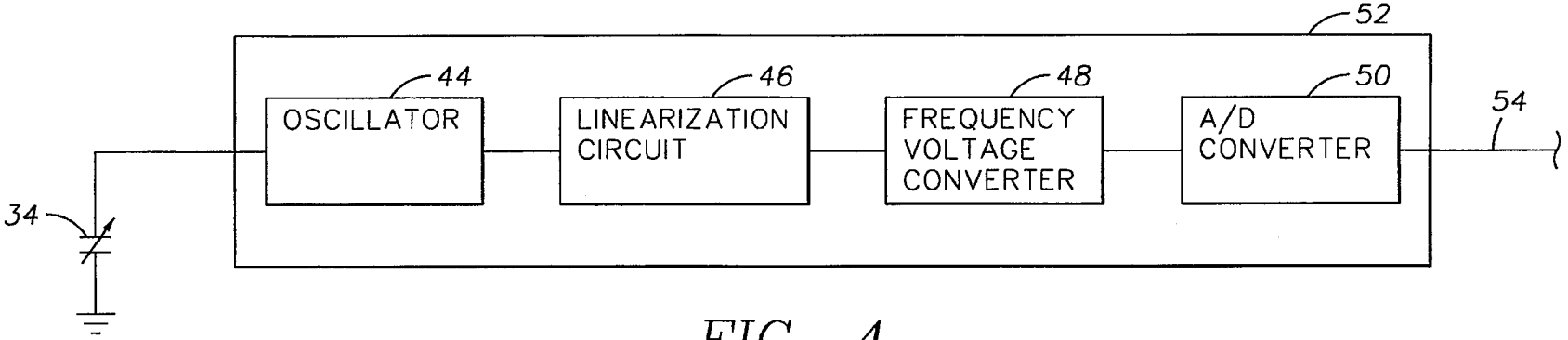
FIG. 4 is a schematic diagram of an electronic circuit useful for providing quantitative values of cable elongation.

FIG. 4 is a schematic diagram of a presently-preferred electronic circuit for quantizing the output of the elongation sensor. Given a conventional R/C circuit having a preselected resistance R, sensor 34 serves to provide a variable capacitance, C, for a variable-frequency oscillator 44. The frequency response as a function of elongation and hence capacitance, is not linear. Therefore a logarithmic linearization circuit 46 may be introduced to the output of oscillator 44. A frequency-to-voltage converter 48 of any well known type provides a voltage proportional to frequency. Thus, the sensor provides an electrostatic parameter having a magnitude that is proportional to the instantaneous elongation of the sensor and hence that of the associated isolator section. The analog output of the sensor may be sampled at desired intervals and digitized in an A/D converter 50. The circuitry above recited can be incorporated into a single integrated-circuit chip 52, by means well known to the art, which can be mounted in end termination 26 if desired. The digital output of chip 52 may be coupled by means 54 into one of the auxiliary utility telemetric channels packed into the conductor bundle 32 in isolator section 16 for transmission to the instrumentation 20 in ship 10.

In this disclosure, the description refers to an isolator section by way of example but not by way of limitation. The sensor assembly may be applied for use with one or more of the instrumented active sections 18[1] as well as the isolator section 16. Use of the sensor in active sections is desirable where aramid fibers are used as stress members. Aramid fibers are used to reduce the total cable weight but those fibers stretch a little bit.

This invention has been described with a certain degree of specificity by way of example but not by way of limitation. Those skilled in the art will devise obvious variations to the examples given herein but which will fall within the scope and spirit of this invention which is limited only by the appended claims.

What is claimed is:

1. A seismic streamer-cable section, comprising in combination:

an elongated flexible jacket endowed with a mechanical/electrical termination at opposite ends;

at least one resilient stress member mounted inside said jacket, the opposite ends of which are fastened to the respective terminations;

a plurality of electrical conductors mounted inside said jacket for transmitting electrical signals through said section to a signal-receiving device;

a longitudinally-extensible distributed-capacitance means operatively associated with said jacket;

means, electrically coupled to said distributed-capacitance means, for measuring the change in capacitance as a function of jacket elongation.

2. The seismic cable section as defined by claim 1, wherein said capacitance-measuring means further comprises:

a variable-frequency oscillator electrically coupled to said distributed capacitance means, the output frequency of said variable-frequency oscillator being a function of the instantaneous capacitance of said distributed-capacitance means;

frequency-to-voltage means, electrically coupled to said variable-frequency oscillator for providing a voltage as a function of instantaneous jacket elongation; and means for quantizing said voltage.

3. The seismic streamer cable section as defined by claim 2, the combination further comprising:

means for taking samples of the quantized voltage at selected sample intervals; and means for multiplexing the voltage samples for transmission through selected ones of said electrical conductors.

4. The seismic streamer cable section as defined by claim 3, wherein said section is an isolator section coupled between a ship and a multi-section, instrumented streamer cable.

5. An isolator section for mechanically decoupling a towing ship from a towed instrumented seismic streamer cable, comprising in combination:

an elongated flexible jacket;

an electrical/mechanical end termination secured to each end of said jacket;

at least one resilient stress member mechanically interconnecting the end terminations;

a plurality of electrical conductors for transmitting seismic signals from the instrumented streamer cable to said ship;

variable-gap distributed-capacitance capacitor means operatively associated with the jacket of said isolator section for providing an electrostatic-parameter having a magnitude that is a function of the elongation of the isolator section.

6. The isolator section as defined by claim 5, the combination further comprising:

a variable-frequency oscillator characterized by a preselected resistive component, the capacitative component being provided by said variable-gap capacitor so that the output frequency of said oscillator varies as function of the instantaneous elongation of the isolator section; and means for quantizing the output frequency of said oscillator at preselected sample intervals.

* * * * *